US006838627B1

(12) United States Patent
Isberg et al.

(10) Patent No.: US 6,838,627 B1
(45) Date of Patent: Jan. 4, 2005

(54) CONTACT ELEMENT AND A CONTACT ARRANGEMENT

(75) Inventors: Peter Isberg, Västerås (SE); Björn Hellström, Västerås (SE); Bengt Stridh, Västerås (SE); Anna-Liisa Lönn, Västerås (SE); Rolf Gustafsson, Västerås (SE); Sylvia Arnell, Västerås (SE); Pan Min, Uppsala (SE)

(73) Assignee: ABB AB, Vasteras (SE)

( * ) Notice: Subject to any disclaimer, the term of this patent is extended or adjusted under 35 U.S.C. 154(b) by 30 days.

(21) Appl. No.: 10/148,404

(22) PCT Filed: Nov. 14, 2000

(86) PCT No.: PCT/SE00/02223

§ 371 (c)(1),
(2), (4) Date: May 30, 2002

(87) PCT Pub. No.: WO01/41167

PCT Pub. Date: Jun. 7, 2001

(30) Foreign Application Priority Data

Nov. 30, 1999 (SE) ..... 9904350

(51) Int. Cl.[7] ..... H01H 1/02; H01H 9/30

(52) U.S. Cl. ..... 200/262; 200/278; 218/146; 335/196; 310/251

(58) Field of Search ..... 200/11 TC, 15, 200/262–270, 16 A, 243, 275, 547–549, 562–563, 278; 338/143, 176, 202; 335/196; 428/209, 210, 685, 689, 697, 701, 702, 544–565, 688, 698; 310/251–253, 68 A, 71; 218/16, 48.65; 423/414, 439, 440, 447.2

(56) References Cited

U.S. PATENT DOCUMENTS

| | | | | | |
|---|---|---|---|---|---|
| 4,312,900 | A | | 1/1982 | Simpson | 427/181 |
| 4,422,918 | A | | 12/1983 | Inoue | 310/249 |
| 4,553,417 | A | | 11/1985 | Badger | 72/42 |
| 5,235,743 | A | * | 8/1993 | Endo et al. | 439/886 X |
| 5,270,504 | A | | 12/1993 | Grohs et al. | 200/265 |
| 5,316,507 | A | | 5/1994 | Capp | 439/866 |
| 5,597,064 | A | | 1/1997 | Ozaki et al. | 200/269 |
| 5,934,900 | A | * | 8/1999 | Billings | 432/264 |
| 6,544,674 | B2 | * | 4/2003 | Tuller et al. | 428/698 |

FOREIGN PATENT DOCUMENTS

| | | |
|---|---|---|
| EP | 0612085 | 8/1994 |
| WO | 94 19814 | 9/1994 |
| WO | 0033421 | 6/2000 |
| WO | 0033422 | 6/2000 |

* cited by examiner

*Primary Examiner*—James R. Scott
(74) *Attorney, Agent, or Firm*—Oblon, Spivak, McClelland, Maier & Neustadt, P.C.

(57) ABSTRACT

An element (20) for making an electric contact to another contact member (19) for enabling an electric current to flow between said element (20) and said contact member comprises a body having at least a contact surface thereof coated with a contact layer (21) to be applied against said contact member. This contact layer comprises a continuous film comprising a laminated multielement material having strong bonds, such as covalent or metallic bonds, within each atomic layer and weaker bonds, through larger bonding distance or for example as van der Waals bonds or hydrogen bonds, between at least some adjacent atomic layers thereof.

46 Claims, 2 Drawing Sheets

CONTACT ELEMENT AND A CONTACT ARRANGEMENT

TECHNICAL FIELD OF THE INVENTION AND PRIOR ART

The present invention relates to an element for making an electric contact to another contact member for enabling an electric current to flow between said element and said contact member, said element comprising a body having at least a contact surface thereof coated with a contact layer to be applied against said contact member, as well as a sliding electric contact arrangement in which two contact surfaces adapted to be applied against each other for establishing an electric contact may slide with respect to each other when establishing and/or interrupting and/or maintaining the contact action.

Such a contact element may have many different applications, in which said contact layer is arranged for establishing a contact to a contact member with desired properties, such as a low contact resistance and a low friction coefficient with respect to the material of the contact member to be contacted etc. Such applications are for instance for making contacts to semiconductor devices in a wafer of one or more such devices, for establishing and interrupting electric contact in mechanical disconnectors and breakers and for establishing and interrupting electric contacts in contact arrangements of plug-in type. Such electric contact elements, which may establish sliding contacts or stationary contacts has preferably a body made of for instance copper or aluminium. It is known to coat said body with a contact layer of metal for protecting contact surfaces of the contact element against wear and corrosion. However, it has turned out that the metals used until now for such a contact layer have shown a tendency to get stuck to the surface on the contact member bearing thereagainst, which may result in damaging surface near portions of the contact element and/or contact member when traction forces attempt to move the contact element with respect to the contact member, for instance as a consequence of a difference in coefficient of thermal expansion of the material of the contact element and that of the contact member upon temperature changes or when the contact element and the contact member are to be moved with respect to each other in a sliding contact. This problem has been solved by lubricating the contact surfaces of the contact element and the contact member with a lubricant. Such a lubricant may have an oil or a fat as base, but solid lubricants, such as graphite or different types of plastics, also exist. However, solid lubricants have a poor electric conductivity and are often worn away when the contact surfaces are sliding against each other.

An example of a contact layer having lubricating properties is given in U.S. Pat. No. 5,316,507. A solid lubricant, graphite of a certain particle size, mixed with a powder of an electrically conducting material, for instance gold, is pressed to a body being sintered. The gold grains are melting together during the sintering and the graphite stays in cavities in the gold. The sintered body is rolled into a band in a plurality of rolling steps with intermediate heat treatments, and the band is used as a conducting and lubricating contact layer for contact elements. A disadvantage of this electrically conducting and lubricating contact layer is that it requires a complicated and therefore very costly manufacturing process.

A problem when using a lubricant based on fat or oil is that it is difficult to apply a uniform layer of the lubricant on the contact surface. Thick films of the lubricant influence the electric properties negatively and thin films of the lubricant are often worn away by mechanical influence. Another problem when using a lubricant is that it is volatile and will thereby contaminate other components. An additional problem is that the lubricant is sticky, which means that it gets stuck on components not to be lubricated and that it will easily absorb impurities, such as particles and dust, which may result in an increased contact resistance. The impurities in the lubricant may also result in a greater tendency of the lubricant to oxidise and thereby become less resistant.

SUMMARY OF THE INVENTION

The object of the present invention is to provide an electric contact element having a contact layer with a low friction without the disadvantages mentioned above of such layers already known in connection with use and/or manufacture thereof.

This object is according to the invention obtained by providing such a contact element having a contact layer in the form of a continuous film comprising a laminated multielement material having strong bonds, such as covalent or metallic bonds, within each atomic layer and weaker bonds, through longer bonding distance or for example as van der Waals bonds or hydrogen bonds, between at least some adjacent atomic layers thereof.

It has turned out that a film of laminated material is excellent as a contact layer on a contact element in question for many reasons. The friction coefficient thereof is very low, typically 0.01–0.1. This is due to the fact that the atom layers are arranged alternatingly, e.g. when the material is $MoS_2$ molybdenum and sulphur layers. The bonds between these layers are weak. Accordingly, when laminated material of this type comes into contact with another layer only the uppermost atom layer is sheared against the opposite surface of a said contact member resulting in a very low friction. Furthermore, said materials have low tendency to form oxides, which degrade electric contact to said contact member. Furthermore, said laminated materials have a low contact resistance to metallic surfaces. Furthermore, the materials are relatively chemical inert and stable at temperatures exceeding 400° C. A material being laminated according to the invention, i.e. with strong bonds within each atomic layer and weak bonds between at least some adjacent atomic layers, may be called a nanolaminated material, since the thickness of the laminates so formed are in the region of 0.1 to 10 nanometers. "multi-element" indicates that the material is made of at least two elements, such as Mo and S, which distinguish it from graphite, which is a single-element material only containing C.

According to another preferred embodiment of the invention said laminated material is $MOS_2$, $WS_2$ or a new class of layered ternary carbides and nitrides that can be described as $M_3AX_2$. M is a transition metal, A is a group A element (such as 3A and 4A) and X is either C or N. The class of materials is also denoted as 312 ceramics. The laminated material could also be H-phase materials $M_2BX$, where M is a transition metal, B is a group B element and X is either C or N. These different materials have turned out to have the preferred features mentioned above.

One of the laminated materials, $Ti_3SiC_2$, is especially preferred due to the excellent mechanical, chemical, electrical and thermal properties of the material.

Accordingly, said laminar films are able to form a self lubricating, dry contact with a very low friction to another member, such as said contact member, which will also result in low operation forces facilitating interconnection of a contact element to another such contact element or contact member and/or results in less power losses in actuating members.

According to different preferred embodiments of the invention laminar compounds of said film will have a morphology varying from amorphous to pure crystalline, and the morphology may be selected in accordance with the particular use of the contact element and/or the costs for producing the film. The films could also consist of fullerene-like nanoparticles, as described in Nature 387, 791 (1997) and Nature 407, 164 (2000). This preferred structural form shows excellent friction and wear properties. "Nanoparticles" is defined as particles having a size between 0.1 and 100 nm.

According to another preferred embodiment of the invention laminar compounds of said film of laminated material is in the range of 0.001 $\mu$m to 1000 $\mu$m, and in a very preferred embodiment of the invention the thickness is less than 5 $\mu$m. Such thin layers may have a lifetime being nearly indefinite thanks to the very low friction of this material, so that in closed systems the result aimed at will be achieved through a very thin film having low costs of material and manufacturing process as a consequence thereof.

According to another preferred embodiment of the invention the thickness of said film of laminated material is above 10 $\mu$m. Such a thickness is preferred in the case of using such a film on a contact element in a contact arrangement where the contact element and the contact member are going to be moved with respect to each other, such as in a sliding contact, and accordingly not only moved by different coefficients of thermal expansion upon thermal cycling, such as when used on a slip ring in an electric rotating machine.

According to another preferred embodiment of the invention said film comprises two sub-layers arranged on top of each other, namely one first sub-layer of laminated material and a second sub-layer of a harder material, such as $CN_x$ (carbon nitride). A combination of such a softer layer and a harder layer is very advantageous, since it will make it possible to obtain a good contact to said member coated with an oxide layer, because the hard material will ensure that the soft material will be pressed through the oxide layer for making said contact. The ductile laminated material will then make a larger contact area than would the hard material. $CN_x$, is super-elastic and adheres well to the underlying substrate when said film is moved with respect to the contact member.

According to another preferred embodiment of the invention the body deeper under said contact surface is made of a material being non-resistant to corrosion, and the material last mentioned is coated by a corrosion resistant material, such as nickel, adapted to receive said film on top thereof. It is preferred to proceed in this way, since the laminated film may have pores with a risk of corrosion of the underlying body material therethrough.

Another object of the present invention is to provide sliding electric contact arrangement of the type defined in the introduction allowing a movement of two contact surfaces applied against each other while reducing the inconveniences discussed above to a large extent.

This object is according to the invention obtained by providing such an arrangement with a contact element according to the present invention with said film arranged to form a dry contact with a very low friction, below 0.2, preferably below 0.1, to a contact member.

The basic features and advantages of such a contact arrangement are associated with the characteristics of the contact element according to the present invention and appear from the discussion above of such a contact element. However, it is pointed out that "sliding electric contact" includes all types of arrangements making an electric contact between two members, which may move with respect to each other when the contact is established and/or interrupted and/or when the contact action is maintained. Accordingly, it includes not only contacts sliding along each other by action of an actuating member, but also so called stationary contacts having two contact elements pressed against each other and moving with respect to each other in the contacting state as a consequence of magneto-striction, thermal cycling and materials of the contact elements with different coefficients of thermal expansion or temperature differences between different parts of the contact elements varying over the time.

A contact arrangement of the type last mentioned constitutes a preferred embodiment of the present invention, and the contact elements may for instance be pressed with a high pressure, preferably exceeding 1 MPa against each other without any mechanical securing means, but the contact elements may also be forced against each other by threaded screws or bolts.

According to another preferred embodiment of the invention said contact arrangement is adapted to be arranged in an electric rotating machine, where the film comprising laminated material will result in a number of advantages. It is in particular possible to benefit from the low friction coefficient of the laminated material when arranging the contact element and the contact member of the contact arrangement on parts of the rotating machine moving with respect to each other, such as for instance the slip ring as a contact element and a contact element sliding there-upon. It will in this way be possible to replace the carbon brushes used in electric rotating machines by a contact element according to the present invention and a film of said type is then also preferably arranged on the moving part, such as a slip ring. Said carbon brushes have a number of disadvantages, such as a restricted lifetime, since the carbon is consumed. Furthermore, carbon dust is spread out on the winding and other parts of the machine, which may disturb the function thereof. It is preferred to have a thickness of the film of laminated material exceeding 10 $\mu$m for such a contact element, since also the film of laminated material will be consumed, but comparatively slowly, in this application thereof.

Electrical contact arrangements according to other preferred embodiments of the invention are different kinds of contacts having contact surfaces moving while bearing against each other in establishing and/or interrupting an electric contact, such as plug-in contacts or different types of spring-loaded contacts, in which it is possible to take advantage of the very low friction coefficient of laminated material resulting in a self-lubricating dry contact without the problems of lubricants such as oils or fats while making it possible to reduce the operation forces and save power consumed in actuating members.

Electrical contact arrangements according to other preferred embodiments of the invention are as included in tap changers on transformers, where a low friction is a great advantage when the contact elements are sliding with their contact surfaces against each other, and in mechanical disconnectors and breakers and in relays. The inert character of the laminated material film may also be used in crimp contacts, then preferably with a body of a material being corrosion resistant or covered by a material having that feature, for instance nickel.

The invention also relates to a use of the contact arrangement according to any of the claims according to the invention relating to a contact arrangement, in which a probe for measuring and testing an integrated circuit is covered with a said laminated film avoiding chemical degradation and metal cladding on the probe. It is selfevident that this use according to the invention is very favourable, since it will make it possible to carry out measurements and testing without any interruptions for replacing or cleaning the probe.

Further advantages as well as advantageous features appear from the following description and the other dependent claims.

BRIEF DESCRIPTION OF THE DRAWINGS

With reference to the appended drawings, below follows a specific description of preferred embodiments of the invention.

In the drawings.

DETAILED DESCRIPTION OF PREFERRED EMBODIMENTS OF THE INVENTION

Figure 1:
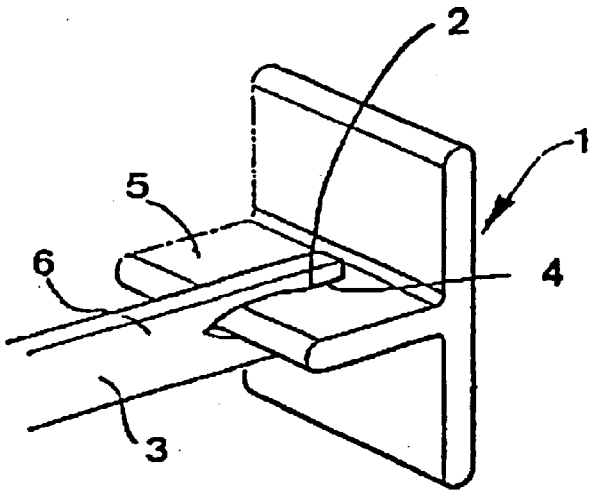
FIG. 1 illustrates an electric contact element of plug-in type according to a preferred embodiment of the invention.

FIG. 1 shows a contact arrangement 1 of plug-in type, in which a contact surface 2 on a contact element 3 slides along and while bearing against contact surfaces 4 on another contact element 5, here called contact member. The contact element 3 has a female character and is present in the form of a resilient jaw adapted to be connected to the male contact member 5 in the form of a contact rail. The contact element 3 is applied on the contact member 5 and bears in the contacting state while being biased by means of at least a contact surface 2 against a contact surface 4 on the contact member 5.

At least one of the contact surfaces 2 and 4, preferably both, are provided with a continuous laminated film comprising $MoS_2$, $WS_2$ or a new class of layered ternary carbides and nitrides that can be described as $M_3AX_2$. M is a transition metal, A is a group A element (such as 3A and 4A) and X is either C or N. The class of materials is also denoted as 312 ceramics. The laminated material could also be H-phase materials $M_2BX$, where M is a transition metal, B is a group B element and X is either C or N. This film may be very thin with a thickness in the range of 0.001 $\mu$m to 1000 $\mu$m and it will have a very low friction coefficient, typically 0.01 to 0.1. This means that the friction forces to be overcome when controlling the contact arrangement for establishing or interrupting the electric contact will be very low resulting in a low necessary power consumption in an actuating member and a nearly neglectible wear of the contact surfaces constituted by this film. Furthermore, the film is chemical inert and stable at temperatures exceeding 400° C. It is pointed out that it is well possible that said continuous film is arranged on only the contact member 5, which of course is a contact element just as the contact element 3. Furthermore, in this case the film comprising laminated material is deposited and adheres to the body 6 of the contact element 3, but in other preferred embodiments of the invention it is well possible that said film coats a body by being laid on top thereof as a separate foil. This may in particular be the case for the embodiment shown in FIG. 3 described further below.

The continuous film comprising laminated, or more exactly nanolaminated, material may be deposited on the body of the contact element, being preferably of Cu, by Physical Vapour Deposition (PVD), Chemical Vapour Deposition (CVD), electro-chemically, or with thermal plasma spraying. It is preferred to provide a thin layer of a corrosion resistant material on the body before applying said film would the body be of a material being non-resistant to corrosion, since it is possible that the film will have some pores reaching therethrough.

Figure 2:
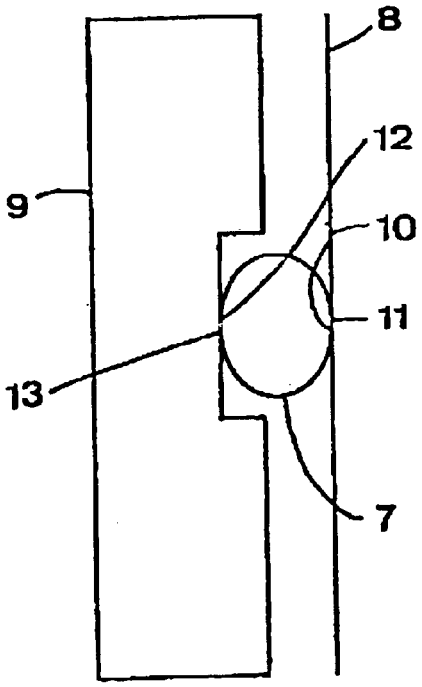
FIG. 2 is a sectioned view of an electric contact element of helical contact type according to another preferred embodiment of the invention.

FIG. 2 illustrates a further example of a contact arrangement in which it is advantageous to coat at least one of the contact surfaces with a continuous film comprising laminated material for forming a self lubricating dry contact with a very low friction according to the present invention. This embodiment relates to a helical contact arrangement having a contact element 7 in the form of a spring-loaded annular body, such as a ring of a helically wound wire, adapted to establish and maintain an electric contact to a first contact member 8, such as an inner sleeve or a pin, and a second contact member 9, such as an outer sleeve or tube. The contact element 7 is in a contact state compressed so that at least a contact surface 10 thereof will bear spring-loaded against a contact surface 11 of the first contact member 8 and at least another contact surface 12 of the first contact element 7 will bear spring-loaded against at least a contact surface 13 of the second contact member 9. According to this preferred embodiment of the invention at least one of a contact surfaces 10–13 is entirely or partially coated with a continuous low friction film comprising laminated material. Such a helical contact arrangement is used for example in an electrical breaker in a switch gear.

Figure 3:
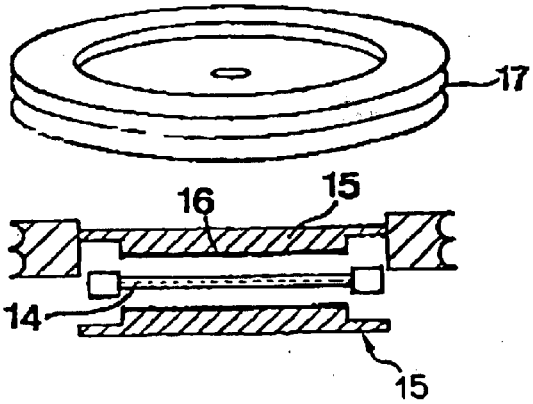
FIG. 3 is a partially sectioned and exploded view of an arrangement for making an electric contact to a semiconductor chip according to a preferred embodiment of the invention.

An arrangement for making a good electric contact to a semi-conductor component 14 is illustrated in FIG. 3, but the different members arranged in a stack and pressed together with a high pressure, preferably exceeding 1 MPa and typically 6–8 MPa, are shown spaced apart for clarity. Each half of the stack comprises a pole piece 15 in the form of a Cu plate for making a connection to the semiconductor component. Each pole piece is provided with a thin continuous film 16 comprising laminated material. The coefficient of thermal expansion of the semiconductor material, for instance Si, SiC or diamond, of the semi-conductor component and of Cu differs a lot ($2.2\times10^{6}$/K for Si and $16\times10^{-6}$/K for Cu), which means that the Cu plates 15 and the semiconductor component 14 will move laterally with respect to each other when the temperature thereof changes. Contact arrangements of this type according to the stand of the art require for that sake one or several further members in said stack between the pole piece and the semiconductor component for taking care of this tendency to mutual movements upon thermal cycling for avoiding cracks in the semiconductor component and/or wear of the contact surface of said component. However, the very low friction of a film according to the present invention makes it possible to omit all these additional members and making the contact arrangement less costly, not at the least by allowing the use of a cheap material without any need of thermal matching close to the semiconductor component. A contact arrangement of this type is a part of a power electronic encapsulation 17 forming a closed system, and practically no material will be consumed when the film moves along the semiconductor component upon thermal cycling so that the lifetime thereof will be practically indefinite.

Figure 4:
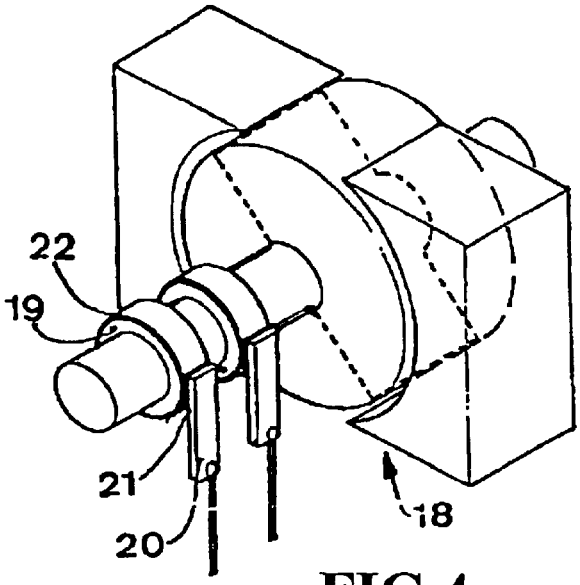
FIG. 4 illustrates very schematically a sliding contact arrangement in an electric rotating machine according to a further embodiment of the invention.

A sliding contact arrangement according to another preferred embodiment of the invention is schematically illustrated in FIG. 4 as used in an electric rotating machine 18 of any type for establishing an electric contact between a slip ring 19 and a contact element 20, which here replaces a carbon brush and is made of a body of for instance copper or aluminium coated with a continuous film 21 comprising laminated material. The outer surface of the slip ring 19 is preferably also coated by such a film indicated at 22. This results in a very low friction electric contact having a low contact resistance. It would also be possible to use a contact arrangement having a continuous film of laminated material between two members moving with respect to each other in an electric rotating machine for avoiding a static electricity to be built up.

Figure 5:
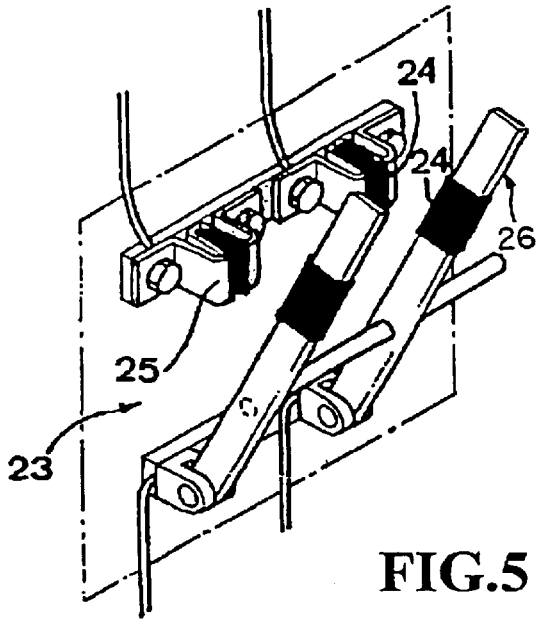
FIG. 5 illustrates very schematically a contact arrangement according to the present invention in a disconnector.

FIG. 5 illustrates very schematically how an electric contact arrangement according to the invention may be arranged in a disconnector 23 with a low friction film 24 comprising laminated material on at least one of the contact surfaces of two contact elements 25, 26 movable with respect to each other for establishing an electric contact therebetween and obtaining a visible disconnection of the contact elements.

Figure 6:
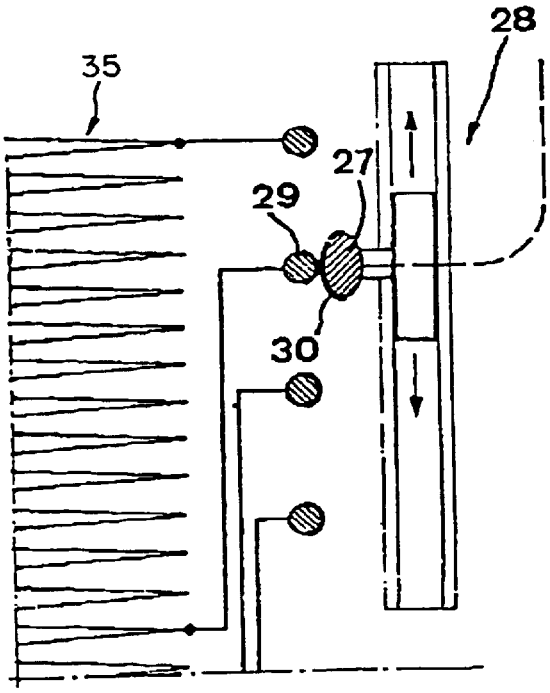
FIG. 6 illustrates very schematically a sliding contact arrangement in a tap changer of a transformer according to a preferred embodiment of the invention.

FIG. 6 illustrates schematically a sliding electric contact arrangement according to another preferred embodiment of the invention, in which the contact element 27 is a movable part of a tap changer 28 of a transformer adapted to slide in electric contact along contacts 29 to the secondary winding 35 of the transformer, accordingly forming the contact member, for tapping voltage of a level desired from said transformer. A low friction film 30 comprising laminated material is arranged on the contact surface of the contact element 27 and/or on the contact member 29. The contact element 27 may in this way be easily moved along the contact member 29 while maintaining a low resistance contact thereto.

Figure 7:
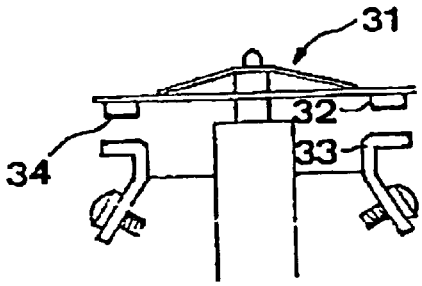
FIG. 7 illustrates very schematically a contact arrangement according to the present invention in a relay.

Finally, FIG. 7 illustrates very schematically a contact arrangement according to another preferred embodiment of the invention used in a relay 31, and one or both of the contact surfaces of opposite contact elements 32, 33 may be provided with a low friction film 34 comprising $MoS_2$, which will result in less wear of the contact surfaces and make them corrosion resistant as a consequence of the character of laminated material.

A contact element and a sliding electric contact arrangement according to the present invention may find many other preferred applications, and such applications would be apparent to a man with ordinary skill in the art without departing from the basic idea of the invention as defined in the appended claims.

It would for example be possible to dope the thin low friction film for improving friction, thermal, mechanical or electrical properties by one or several compounds. However, the amount of doping should not exceed 20 weight-% of the film. It is then also possible to have different films on different contact surfaces of the contact element and the contact member, for instance some doped and others not or some formed by at least two sub-layers and others having only one layer.

Furthermore, the contact elements and arrangements of the invention are not restricted to any particular system voltages, but may be used in low, intermediate and high voltage applications.

The laminated material of the contact layer according to the invention may form an alloy together with 50–70% of a metal, for instance of Ti or Au, for improving the conductivity and reduce the absorption of moisture. This may take place by forming a homogeneous dispersion of the metal in the material or by arranging a layer of the chemical compound, such as $MoS_2$ and a layer of the metal alternatingly.

What is claimed is:

1. An element for making an electric contact to another contact member for enabling an electric current to flow between said element and said contact member, said element comprising a body having at least a contact surface thereof coated with a contact layer for contacting said contact member, wherein said contact layer comprises a continuous film comprising a laminated multielement material comprising a plurality of atomic layers, wherein the atoms within each of the layers are bonded by strong bonds and at least a portion of adjacent layers are bonded be weak bonds.

2. The element according to claim 1, wherein said laminated material is at least one of $MoS_2$, $WS_2$ layered ternary carbides or a layered ternary nitrides having formula $M_3AX_2$, in which M is a transition metal, A is a group A element, and X is either C or N, or any H-phase material having formula $M_2BX$, in which M is a transition metal, B is a group B element and X is either C or N.

3. The element according to claim 2, wherein the group A element is at least one of a group 3A or group 4A element.

4. The element according to claim 1, wherein the laminated material is in an amorphous state.

5. The element according to claim 1, wherein the laminated material is at least partially crystalline.

6. The element according to claim 1, wherein the strong bonds are at least one of covalent bonds or metallic bonds and the weak bonds are at least one of Van der Waals bonds or hydrogen bonds.

7. The element according to claim 1, wherein said film has crystalline regions of $MoS_2$ mixed with amorphous regions of $MoS_2$.

8. The element according to claim 1, wherein the laminated material of said film is in a crystalline state.

9. The element according to claim 1, wherein the laminated material comprises nanoparticles with fullerene structure.

10. The element according to claim 1, wherein the thickness of said film is in the range of 0.001 $\mu$m to 1000 $\mu$m.

11. The element according to claim 10, wherein said thickness is smaller than 5 $\mu$m.

12. The element according to claim 10, wherein said thickness exceeds 10 $\mu$m.

13. The element according to claim 1, wherein said film is deposited on said body and adheres thereto.

14. The element according to claim 13, wherein said film is formed on said body by an electrolytic method.

15. The element according to claim 13, wherein said film is deposited on said body by vapor deposition.

16. The element according to claim 15, wherein said film is deposited on said body by Physical Vapour Deposition or Chemical Vapour Deposition.

17. The element according to claim 13, wherein said film is deposited on said body by dipping the body in a chemical solution or spraying the chemical solution on said body.

18. The element according to claim 17, wherein the chemical solution is deposited on said body by thermal spraying or plasma spraying.

19. The element according to claim 1, wherein said film is obtained by laying a foil onto said body.

20. The element according to claim 1, wherein said film has a plurality of superimposed sub-layers and at least one first sub-layer is made of $MoS_2$.

21. The element according to claim 20, wherein said film comprises two said sub-layers, and wherein a second sub-layer is made of a material having a friction coefficient lower than 0.3 and harder than said laminated material.

22. The element according to claim 21, wherein said hard material is $CN_x$.

23. The element according to claim 1, wherein at least said contact surface of said body is metallic.

24. The element according to claim 23, wherein the body is made of a non-corrosion resistant material coated with a corrosion resistant material receiving said film on top thereof.

25. The element according to claim 24, wherein the corrosion resistant material is nickel.

26. The element according to claim 1, wherein at least said contact surface of said body is made of a ceramic material.

27. The element according to claim 1, wherein at least said contact surface of said body is made of a polymeric material.

28. The element according to claim 1, wherein said film is doped by one or more compounds.

29. A sliding electric contact comprising two contact surfaces for establishing an electric contact between the contact surfaces, slidably configured with respect to each other to establish, interrupt or maintain contact action, and the contact element according to claim 1, wherein said film is a dry contact with a friction coefficient below 0.2, to a contact member.

30. The contact according to claim 29, wherein said contact member also further comprises a contact surface coated with a film comprising a laminated film.

31. The contact according to claim 29, wherein the surfaces of the contact element and the contact member and movable with respect to each other in response to different coefficients of thermal expansion of the materials of surface portions of the contact element and the contact member upon temperature changes of the contact element and the contact member.

32. The contact according to claim 31, wherein the contact element and the contact member pressable towards each other for establishing said contact.

33. The contact according to claim 31, wherein the contact element and the contact member are forceable against each other by bolts or screws for establishing said electric contact therebetween.

34. The contact according to claim 29, wherein said contact element and contact member establish an electric contact in an electric rotating machine.

35. The contact according to claim 34, wherein the contact element and the contact member establish a contact between two parts of the machine with respect to each other when the machine is in operation with the contact element and the contact member is arranged on a separate part.

36. The contact according to claim 35, wherein one of said moving parts is a slip ring.

37. The contact according to claim 35, wherein the thickness of said film exceeds 10 $\mu$m.

38. The contact according to claim 29, wherein one of the contact element or the contact member is male-like and the other is female-like, and wherein the contact element and the contact member establish said electric contact for engagement with each other.

39. The contact according to claim 29, wherein said contact comprises means for spring-loading the contact element and the contact member against each other for making said electric contact.

40. The contact according to claim 29, wherein said contact establishes an electric contact in a tap changer for a transformer for making a contact to different winding turns of the transformer.

41. The contact according to claim 29, wherein the contact element and the contact member belongs to two parts of a mechanical disconnector movable away from each other for disconnecting two terminals thereof.

42. The contact according to claim 29, wherein the contact element, and the contact member belongs to two parts of a mechanical breaker movable away from each other for breaking the current path between the terminals thereof.

43. The contact according to claim 29, wherein said contact element and said contact member belong to a crimp contact.

44. The contact according to claim 29, wherein said contact element and said contact member belong to the parts movable with respect to each other in a relay for establishing an electric contact therebetween when the relay operates.

45. The contact of claim 29, wherein the friction coefficient is below 0.1.

46. A method comprising contacting an integrated circuit with the contact element of the contact according to claim 29 to measure and test the integrated circuit.

* * * * *